US012497136B2

(12) United States Patent
Mariotti

(10) Patent No.: US 12,497,136 B2
(45) Date of Patent: Dec. 16, 2025

(54) HULL STRUCTURE

(71) Applicant: INTERMARINE S.P.A., Sarzana (IT)

(72) Inventor: Massimo Mariotti, Sarzana (IT)

(73) Assignee: Intermine—S.p.A., Sarzana (IT)

( * ) Notice: Subject to any disclaimer, the term of this patent is extended or adjusted under 35 U.S.C. 154(b) by 482 days.

(21) Appl. No.: 17/788,065

(22) PCT Filed: Dec. 22, 2020

(86) PCT No.: PCT/IB2020/062340
§ 371 (c)(1),
(2) Date: Jun. 22, 2022

(87) PCT Pub. No.: WO2021/130674
PCT Pub. Date: Jul. 1, 2021

(65) Prior Publication Data

US 2023/0039924 A1 Feb. 9, 2023

(30) Foreign Application Priority Data

Dec. 23, 2019 (IT) ..... 102019000025357

(51) Int. Cl.
*B63B 5/24* (2006.01)
*B63B 3/34* (2006.01)
*B63B 11/02* (2006.01)

(52) U.S. Cl.
CPC ..... *B63B 5/24* (2013.01); *B63B 3/34* (2013.01); *B63B 11/02* (2013.01)

(58) Field of Classification Search
CPC ..... B63B 5/24; B63B 3/34; B63B 11/02
See application file for complete search history.

(56) References Cited

U.S. PATENT DOCUMENTS 5,533,463 A * 7/1996 Marchetti ..... B63B 11/04 114/74 R
2008/0035041 A1* 2/2008 Buzzi ..... B63B 43/10 114/69

FOREIGN PATENT DOCUMENTS

AU 2007200791 A1 9/2008
CN 107330894 A 11/2017
EP 0194531 A1 * 9/1986 ..... B63B 5/24
EP 0 648 669 A1 4/1995
EP 0 870 673 A1 10/1998
(Continued)

OTHER PUBLICATIONS

Italian Search Report Corresponding to 201900025357 mailed Aug. 20, 2020.

(Continued)

*Primary Examiner* — S. Joseph Morano
*Assistant Examiner* — Jovon E Hayes
(74) *Attorney, Agent, or Firm* — Finch & Maloney PLLC

(57) ABSTRACT

Hull structure made of composite material that includes a hull with high thickness "single skin" monocoque plating without reinforcements and an internal stiffening structure (1) formed by a deck (2), two opposing transverse bulkheads (3) and more cradle-shaped load-bearing elements (5) to support components or machinery intended to be housed on board said hull structure. Advantageously, the above-mentioned cradle-shaped load-bearing elements (5) are supported at the respective internal portions of said opposite transverse bulkheads (3) only at their opposite head ends (5*b*).

16 Claims, 4 Drawing Sheets

(56) References Cited

FOREIGN PATENT DOCUMENTS

EP 4081450 B1 * 11/2024 ..... B63B 11/02

OTHER PUBLICATIONS

International Search Report Corresponding to PCT/IB2020/062340 mailed Apr. 19, 2021.
Written Opinion Corresponding to PCT/IB2020/062340 mailed Apr. 19, 2021.
Chinese Search Report corresponding to CN 2020800894703 mailed May 30, 2025.
Chinese First Office Action corresponding to CN 2020800894703 mailed May 30, 2025.

* cited by examiner

HULL STRUCTURE

The present invention relates to a hull structure in accordance with the preamble of claim 1 having a high shock resistance and a so-called low acoustic and magnetic shelf mark.

BACKGROUND OF THE INVENTION

A hull structure of the above-mentioned type is suitable for use, for example, but not limited to, for the construction of ships or boats used for locating and destroying naval mines, called mine countermeasures ships (hereinafter referred to as CMM ships).

For the sake of simplicity, the present description is given, by way of example and not limited to, with particular reference to a CMM ship, being it however evident that the same considerations can also be referred to other types of ships/boats wherein this configuration can be advantageous.

The features that the CMM ships must respect are at least the following ones: low magnetic shelf mark, low acoustic shelf mark and high resistance to shock.

With regard to the low magnetic shelf mark and the low acoustic shelf mark, it should be noted that these are necessarily features to be respected since marine mines are generally equipped with sensitive activation devices, that is to say they can be activated, following the detection of appropriate magnetic signals. and/or background noise emitted by ships.

As far as the high shock resistance is concerned, it is only necessary to highlight how this feature is essential to preserve the integrity of the hull, the components and the crew of a CMM ship in the unfortunate case in which the explosion of a mine nearby takes place.

The adoption of a hull made of composite material, which is inherently non-magnetic and non-conductive, already partially ensures a reduction in the magnetic shelf mark of the naval unit.

However, although advantageous, the adoption of a hull made of reinforced plastic material is not in itself sufficient, as the high resistance to shock is linked to the ability of the hull to deform and transform the incident energy in elastic deformation, but the above-mentioned deformation must be mainly limited to the monocoque plating and transfer only minimally to the internal structures and the relevant set-up components. The deformation capacity of the hull depends not only on the use of the material used but also and above all on the conformation of the hull itself and its structural elements, such as for example the monocoque plating, bulkheads, decks and other items, necessarily present to stiffen the structure of the hull of the ship, since it is very clear that, during navigation, the hull structure must be sufficiently robust to be able to face the sea and the remaining external and internal stresses. In particular, the above-mentioned structural elements of the hull must allow a correct housing and support on board the ship of the various machinery necessary to ensure the correct operation of the ship and to allow it to carry out the task for which it was designed and manufactured.

By way of example, in the context of the present invention, the term machinery will be used to indicate elements such as: motors, generators, machinery and/or other devices or other equipment.

SUMMARY OF THE INVENTION

Given the above, it is evident that nowadays there is still a strong need to have a hull for CMM ships that, in addition to meeting the necessary robustness requirements for the intended use, and to having a low magnetic shelf mark, a feature that can also be partially achieved by adopting non-magnetic/non-magnetic metal material, it also has a low acoustic shelf mark and high shock resistance.

On this item, it should be noted that, up to date, many solutions have been proposed to improve the shock resistance of CMM ships but these known solutions are not fully satisfactory.

The problem underlying the present invention is that of devising a hull structure for ships that has structural and functional features such as to meet the above-mentioned requirement, while obviating the drawbacks mentioned with reference to the known art.

This problem is solved by a hull structure according to claim 1.

In particular, the owner of the present invention has had the opportunity to experiment and to realize that the low acoustic shelf mark and the high shock resistance of the hull are two closely related aspects united by the fact that a hull structure, although capable of meeting the necessary robustness requirements for its use must also be sufficiently flexible in both directions:

- to absorb the stresses that propagate from the outside towards the hull investing it (high resistance to shock) and also
- to absorb vibrations and/or the so-called basic noise that from inside the hull would tend to propagate in the water towards the outside of the hull, thus allowing to minimize the acoustic shelf mark of the ship.

The hull structure according to the invention therefore allows to meet the above-mentioned need by absorbing both the above-mentioned stresses and the vibrations and noise emitted by the ship.

DESCRIPTION OF DRAWINGS

Further features and advantages of the hull structure according to this invention will be apparent from the following description of a preferred embodiment thereof, given by way of non-limiting example, with reference to the attached figures, wherein.

DETAILED DESCRIPTION

Figure 1:
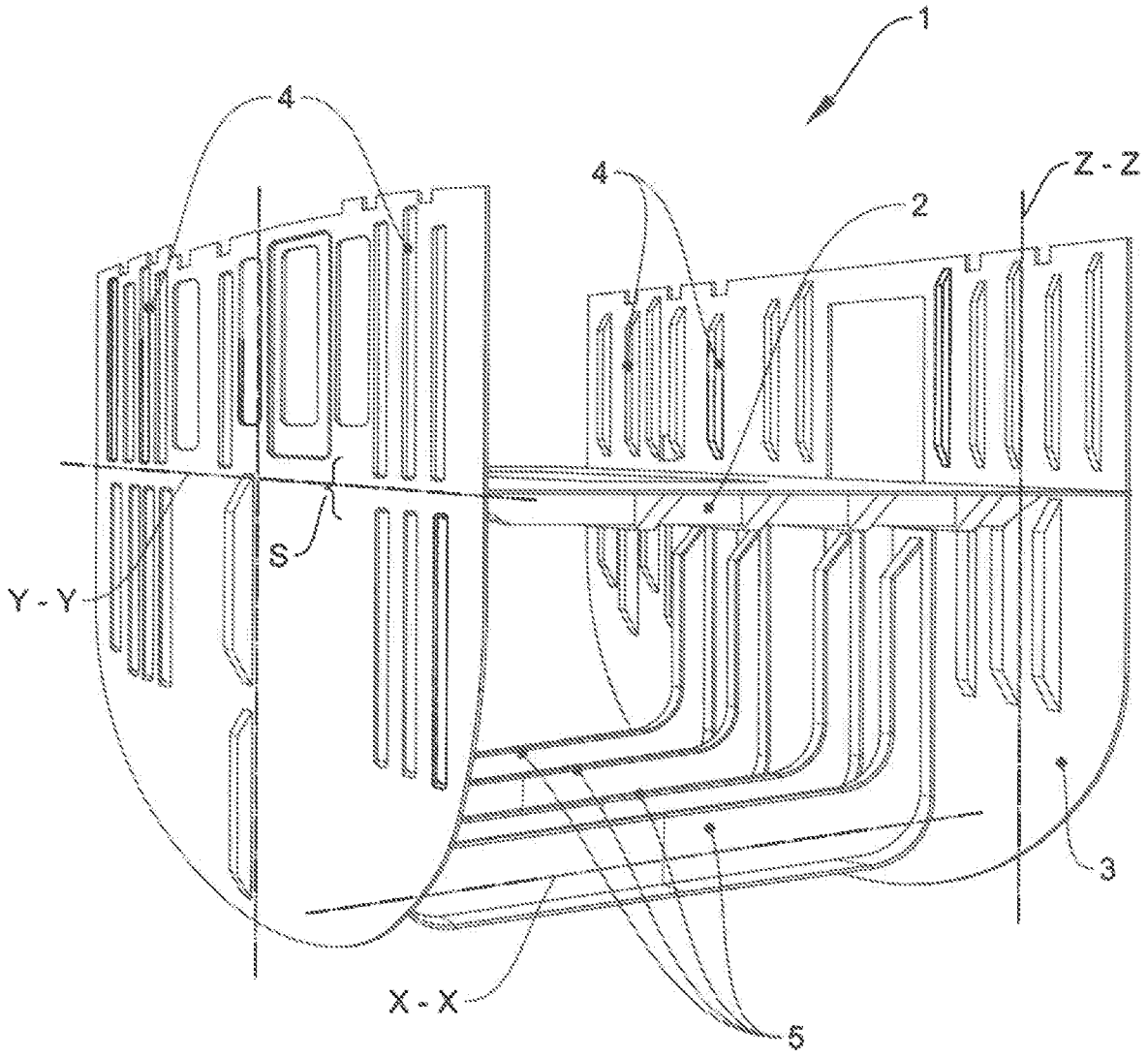
FIG. 1 represents a simplified perspective view of a structural portion of the hull according to the invention.

With reference to the attached figures, according to the invention, a hull structure (not represented in its entirety for simplicity of representation) of a ship is made of suitably reinforced plastic material.

Preferably, said suitably reinforced plastic material is a thermosetting composite material reinforced with fibers and/or fillers.

This hull structure extends from bow to stern in a longitudinal X-X direction and comprises a monocoque plating, a platform, a main deck, a zerounolevel deck, weather decks which are extended for the entire longitudinal length of the ship, transverse bulkheads, one or more internal stiffening structures 1 and other structural elements.

With reference to the monocoque plating, it should be noted that it is a "single skin" monocoque plating (i.e., a "mono shell") with a high thickness and without added reinforcements, such as longitudinal or transverse stiffening ribs, to ensure the necessary deformability of the solution.

Purely by way example and not limited to, a high thickness of the monocoque plating means a monolithic laminate having a thickness ranging from 5 cm (for example, for the sides) to 20 cm or more (for example, for the bottom).

In particular, the above-mentioned internal stiffening structures 1 include:

at least one deck 2;

at least two opposite transverse bulkheads 3 extending vertically and in a transverse direction Y-Y orthogonal to said longitudinal direction X-X and to said at least one deck 2 and one or more cradle-shaped load-bearing elements 5 to support machinery intended to be housed on board the ship.

Said one or more cradle-shaped load-bearing elements 5 extend in the above-mentioned longitudinal direction X-X between opposite head ends 5*b*.

Figure 2:
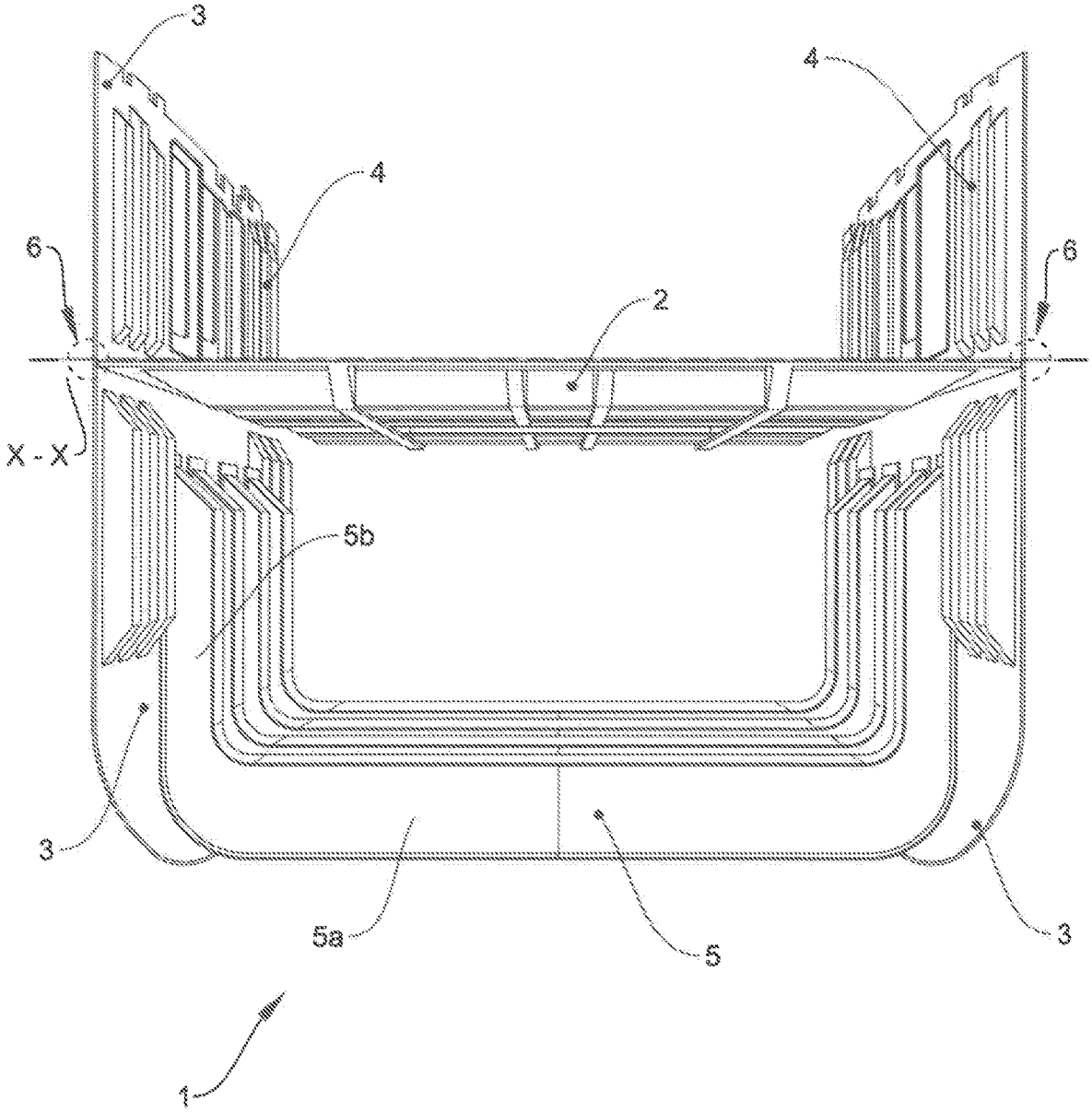
FIG. 2 represents a perspective view in the transverse direction of the structural portion of FIG. 1.
Figure 3:
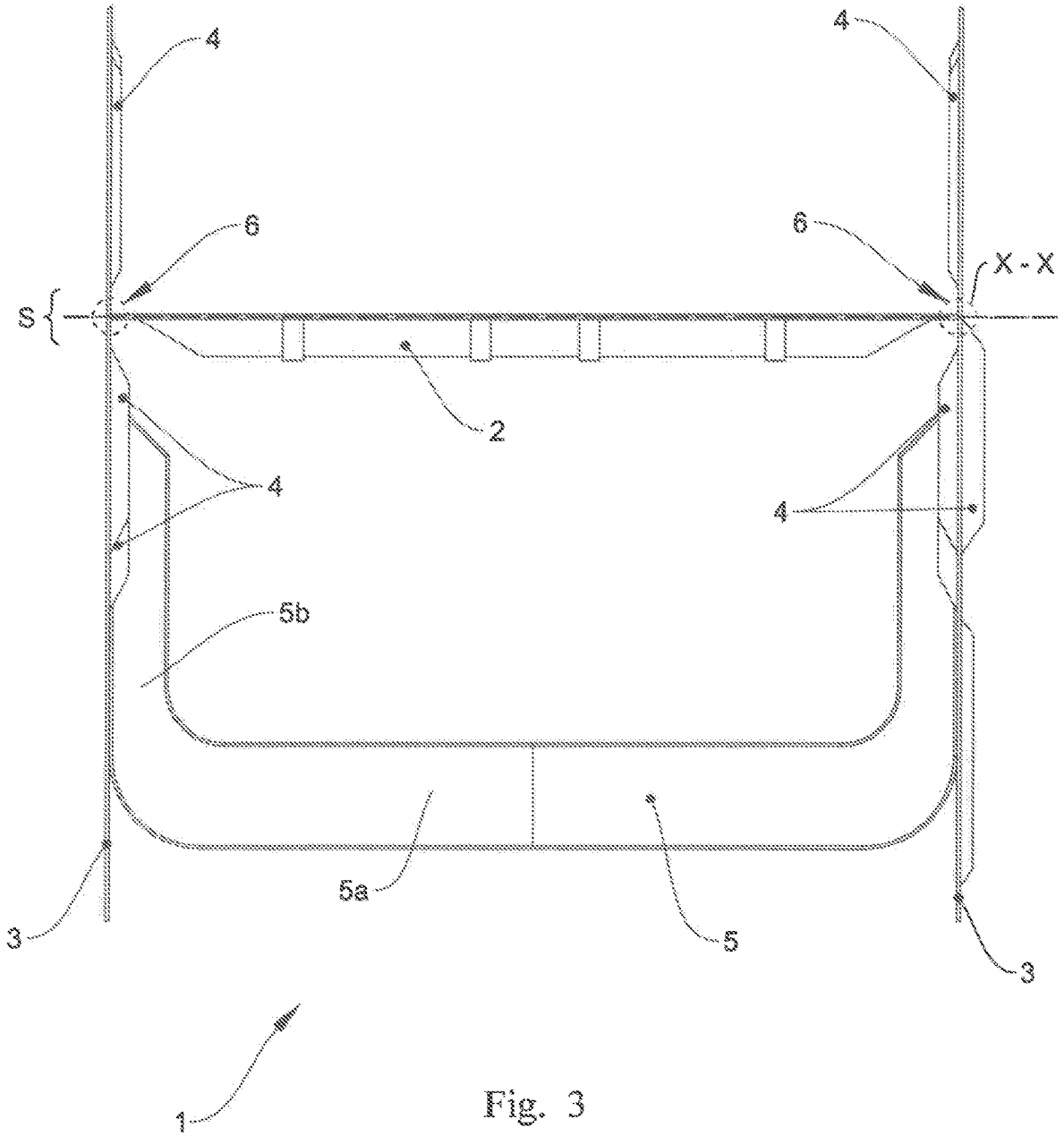
FIG. 3 represents a transverse plan view of the structural portion of FIG. 1
Figure 4:
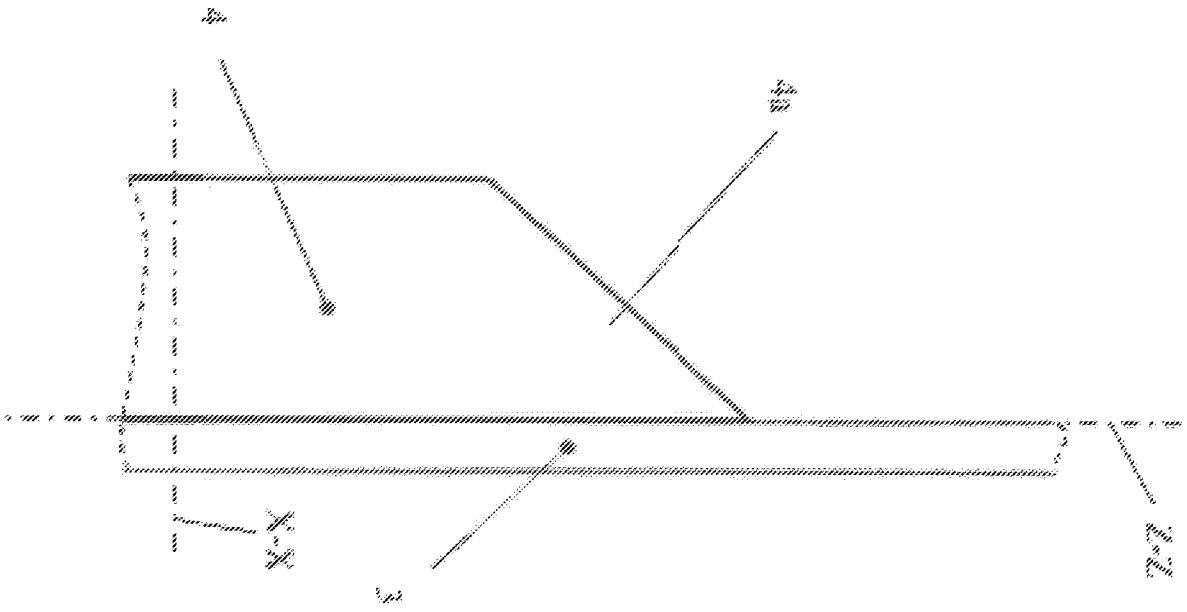
FIG. 4 represents a side plan view of an end detail of a reinforcing rib of the structural portion of FIG. 1.

It should be noted that the attached FIGS. 1, 2 and 3 show a simplified and exemplary form of a structural solution comprising:

two opposing transverse bulkheads 3, a deck 2 extended between said two opposite transverse bulkheads 3 and four cradle-shaped load-bearing elements 5 arranged parallel to each other along the longitudinal direction.

However, it is clear that the ship's hull structure as a whole includes:

more than two transverse bulkheads 3 appropriately distributed in the longitudinal direction X-X;

several decks 2 extended between the above-mentioned transverse bulkheads 3 and a plurality of cradle-shaped load-bearing elements 5 extended between the above-mentioned transverse bulkheads 3 to support the different machinery that must be housed on board the ship. Furthermore it is stressed that the figures do not show further structural elements such as, for example, the bottom of the hull, the platform, the main deck, the zerounolevel deck, weather decks extended for the entire longitudinal length of the ship, the sides of the hull and other further structural elements of the hulls of ships.

It is also specified that, in the context of this description, the construction details on the basis of which the above-mentioned bulkheads are secured, in a watertight or non-watertight manner depending on the specific needs to be met, to the remaining parts of the ship's structure are neither indicated nor described.

Preferably, the above-mentioned cradle-shaped load-bearing elements 5 comprise:

a body 5*a* extended in said longitudinal direction X-X between the above-mentioned at least two opposite transverse bulkheads 3 and opposite head ends 5*b* extended in said vertical direction Z-Z and connected to said transverse bulkheads 3.

According to the invention, the above-mentioned one or more cradle-shaped load-bearing elements 5 are connected to the transverse bulkheads 3:

only in correspondence with the above-mentioned opposite head ends 5*b* of the cradle-shaped load-bearing elements 5 and only from respective first portions of said opposing transverse bulkheads (3) that identify internal portions of said transverse bulkheads Preferably, the above-mentioned first portions of said transverse bulkheads 3 that are connected to the head ends 5B of the cradle-shaped load-bearing elements 5, compatibly with the design constraints, are spaced at least 30 cm, more preferably at least 50 cm, from the peripheral edge of said transverse bulkheads 3, that is to say from the point where said transverse bulkheads 3 are attached to the hull monocoque plating or to the decks. This allows to guarantee the flexibility of the structure and to minimize the transfer of loads to the internal components by means of an elastic hinged behavior of said transverse bulkheads (3).

Preferably, the above-mentioned transverse bulkheads 3 comprise respective stiffening ribs 4 extending axially in a prevalent vertical direction Z-Z. These stiffening ribs 4 therefore identify stiffening uprights for the transverse bulkheads (3).

Preferably, the above-mentioned stiffening ribs 4 terminate with opposing flute-beak tapered head ends 4*a*, so as to:

avoid the onset of unwanted stresses concentrated at the head ends 4*a* of the stiffening ribs 4 and guarantee the necessary flexibility of the structure.

The above-mentioned uprights 4 also stop at a predetermined distance, preferably at least 10 cm, more preferably at least 20 cm, even more preferably at least 30 cm compatibly with the design constraints, from the peripheral edge of the transverse bulkheads 3.

Consequently, along the entire peripheral edge of the above-mentioned transverse bulkheads 3, a perimeter frame not affected by the stiffening ribs 4 is identified in order to contribute to the implementation of a solution with an elastic hinge behavior.

Preferably, the above-mentioned perimeter frame of the transverse bulkheads 3 not affected by the stiffening ribs 4 has an increased thickness with respect to the remaining part of the bulkhead affected by the ribs, preferably an increased thickness of 15-35%, more preferably an increased thickness of 20-25%.

Preferably, the above-mentioned at least one deck 2 extends in the above-mentioned longitudinal direction X-X between opposite head ends starting from two respective, contiguous and opposite transverse bulkheads 3 so that said deck 2 results to be intercostal between the two above mentioned bulkheads 3.

Preferably, the above-mentioned at least one deck 2 extends in the longitudinal direction X-X for a portion having a longitudinal length corresponding to the longitudinal distance between the two opposing contiguous transverse bulkheads 3 between which said deck 2 extends.

As shown in FIGS. 1 to 3:

the at least one deck 2 extends from the two opposite transverse bulkheads 3 and is secured to the two opposite transverse bulkheads 3 in correspondence with respective contact areas 6 of the transverse bulkheads 3 that are extended in the transverse direction Y-Y along the transverse bulkheads 3.

Consequently, in each transverse bulkhead 3 a transverse portion S is identified that:

incorporates the respective above-mentioned contact area 6 and is devoid of any stiffening ribs in order to contribute to the implementation of a solution with an elastic hinge behavior.

Therefore, the above-mentioned transverse portion S extends for a vertical portion of said transverse bulkheads 3 that is greater than the portion coupled with the deck 2.

More specifically, in each of the above-mentioned transverse bulkheads, 3 the respective stiffening ribs 4 are interrupted at a predetermined distance from the above-mentioned contact area 6, so that, in each vertical bulkhead 3, a transverse strip S without stiffening ribs 4 is identified, called transverse strip S being positioned over the respective contact area 6 in correspondence with said deck 2.

Preferably, the above-mentioned transverse strip S of the transverse bulkheads 3 without stiffening ribs has an increased thickness compared to the remaining part of the bulkhead affected by the ribs, preferably a thickness increased by 15-35%, more preferably a thickness increased by 20-25%.

Preferably:

the above-mentioned transverse bulkheads 3 are made up of transverse structural bulkheads, watertight or not, of the hull, while the above-mentioned at least one deck 2 comprises longitudinal and/or transverse beams.

Advantageously, said transverse bulkheads 3, said at least one deck 2 and said cradle-shaped load-bearing elements 5 are made with said composite material based on suitably reinforced plastic material.

The above-mentioned transverse bulkheads 3 consist of transverse structural bulkheads, watertight or not, of the hull.

The above-mentioned at least one deck 2 comprises longitudinal and/or transverse beams that terminate at a predetermined distance, preferably at least 10 cm, more preferably at least 20 cm, even more preferably at least 30 cm, from the bulkheads (if longitudinal) or from the monocoque plating (if transverse) with corresponding flute-beak tapered ends.

In accordance with the explained embodiment (for example, see FIGS. 1 and 2) the above-mentioned one or more cradle-shaped load-bearing elements 5 comprise a plurality of distinct and parallel elements in said transverse direction Y-Y.

The hull structure according to the invention is intended to be used to constitute a ship wherein the cradle-shaped load-bearing elements 5 support various components, in particular, but not limited to, on-board machinery selected from the group comprising: engines, generators, tanks, machinery and/or other devices or other equipment required on board the ship while underway.

In the case of a CMM ship, the above-mentioned machinery also includes other components to be used during the "research" phase for the search and destruction of mines.

As can be appreciated from what has been described, the hull structure according to the present invention allows to meet the above-mentioned need for shock resistance and at the same time to overcome the drawbacks referred to in the introductory part of the present description with reference to the known art. In fact, the presence of the cradle-shaped load-bearing elements 5 supported only through the transverse bulkheads allows for sufficiently elastic supports to absorb vibrations and noises generated by the use of engines and other on-board machinery. This allows the so-called acoustic shelf mark of the ship to be minimized, since the internal stiffening structure allows the above-mentioned vibrations to be elastically dampened, thus preventing them from being transmitted to the hull monocoque plating and from there propagating into the water in which the ship's hull is submerged.

Furthermore, the fact that the perimeter edge of the transverse bulkheads is devoid of ribs and other various stiffeners means that each bulkhead behaves like a membrane bound to the hull monocoque plating by means of an elastic hinge, thus allowing the vibrations generated by the above-mentioned materials supported by the cradle-shaped load-bearing elements to be absorbed with an effective elastic suspension.

However, it should be noted that the flexibility associated with the high thickness "single skin" monocoque plating without reinforcements in conjunction with the elastic suspension of the above-mentioned stiffening structure of the hull is essential where a mine explodes. In fact, given the above-mentioned elasticity allowed by the structural solution, it is evident that, in the event of strong concentrated stresses due to the explosion of a nearby mine, the hull structure is able to deform without interfering with the internal components even for significant values, thereby transforming the stresses affecting the immersed part of the hull structure into elastic deformation with consequent damping of such stresses.

Another advantage of the hull structure according to the present invention lies in the possibility of making and conforming the various parts according to specific needs without excessive shape limits.

Obviously, a person skilled in the art, in order to meet contingent and specific needs, will be able to make numerous changes and variations in detail to the hull structure according to the present invention described above, all however contained within the scope of protection of the invention as defined by the claims below.

The invention claimed is:

1. A hull structure based on suitably reinforced plastic material, wherein said hull structure extends from bow to stern in a longitudinal direction (X-X) and includes a "single skin" monocoque plating and an internal stiffening structure (1), wherein said internal stiffening structure (1) comprises:

at least one deck (2);

at least two opposite transverse bulkheads (3) extended vertically and in a transverse direction (Y-Y) orthogonal to said longitudinal direction (X-X) and to said at least one deck (2); and one or more cradle-shaped load-bearing elements (5) to support machinery intended to be housed on said hull structure, said one or more cradle-shaped load-bearing elements (5) extending in said longitudinal direction (X-X) between opposite head ends (5*b*), wherein:

said one or more cradle-shaped load-bearing elements (5) are supported:

only at said opposite head ends (5*b*) of said cradle-shaped load-bearing elements (5) and only from respective first portions of said opposite transverse bulkheads (3), and said at least one deck extends in said longitudinal direction between opposed head ends of said at least one deck from said two opposite transverse bulkheads (3), said deck (2) resulting to be intercostal between said opposite transverse bulkheads (3).

2. The hull structure according to claim 1, wherein said first portions of said opposite transverse bulkheads (3) are internal portions spaced at least 30 cm from the peripheral edge of said transverse bulkheads (3).

3. The hull structure according to claim 1, wherein said one or more cradle-shaped load-bearing elements (5) comprise:

a body (5*a*) extended in said longitudinal direction (X-X) between said at least two opposite transverse bulkheads (3) and said opposite head ends (5*b*) of said cradle-shaped load-bearing elements extended in said vertical direction (Z-Z) and connected to said transverse bulkheads (3).

4. A hull structure based on suitably reinforced plastic material, wherein said hull structure extends from bow to stern in a longitudinal direction (X-X) and includes a "single skin" monocoque plating and an internal stiffening structure (1), wherein said internal stiffening structure (1) comprises:

at least one deck (2);

at least two opposite transverse bulkheads (3) extended vertically and in a transverse direction (Y-Y) orthogonal to said longitudinal direction (X-X) and to said at least one deck (2); and one or more cradle-shaped load-bearing elements (5) to support machinery intended to be housed on said hull structure, said one or more cradle-shaped load-bearing elements (5) extending in said longitudinal direction (X-X) between opposite head ends (5*b*), wherein said one or more cradle-shaped load-bearing elements (5) are supported:

only at said opposite head ends (5*b*) of said cradle-shaped load-bearing elements (5) and only from respective first portions of said opposite transverse bulkheads (3), wherein said transverse bulkheads (3) comprise stiffening ribs (4) extending axially in a prevailing vertical direction (Z-Z).

5. The hull structure according to claim 4, wherein said stiffening ribs (4) end with opposing flute-beak tapered ends.

6. The hull structure according to claim 4, wherein said stiffening ribs (4) stop at a predetermined limited distance of at least 10 cm, from a peripheral edge of said transverse bulkheads (3), along an entirety of the peripheral edge of the transverse bulkheads (3) resulting in a perimeter frame without stiffening ribs (4).

7. The hull structure according to claim 6, wherein said perimeter frame without stiffening ribs (4) has an increased thickness by 15-35% with respect to the remaining part of the bulkhead where said stiffening ribs are located (4).

8. The hull structure according to claim 1, wherein said at least one deck (2) extends in said longitudinal direction (X-X) and has a longitudinal length corresponding to the longitudinal distance between said two opposite contiguous transverse bulkheads (3) between which said deck (2) extends.

9. A hull structure based on suitably reinforced plastic material, wherein said hull structure extends from bow to stern in a longitudinal direction (X-X) and includes a "single skin" monocoque plating and an internal stiffening structure (1), wherein said internal stiffening structure (1) comprises:

at least one deck (2);

at least two opposite transverse bulkheads (3) extended vertically and in a transverse direction (Y-Y) orthogonal to said longitudinal direction (X-X) and to said at least one deck (2); and one or more cradle-shaped load-bearing elements (5) to support machinery intended to be housed on said hull structure, said one or more cradle-shaped load-bearing elements (5) extending in said longitudinal direction (X-X) between opposite head ends (5*b*), wherein said one or more cradle-shaped load-bearing elements (5) are supported:

only at said opposite head ends (5*b*) of said cradle-shaped load-bearing elements (5) and only from respective first portions of said opposite transverse bulkheads (3), wherein:

said at least one deck (2) is jointed to said two opposite transverse bulkheads (3) in correspondence with respective contact areas (6) extended in said transverse direction (Y-Y) along said transverse bulkheads (3); and in each of said transverse bulkheads (3) a transversal portion(S) is identified which incorporates the respective contact area (6) and is free of any stiffening rib.

10. The hull structure according to claim 9, wherein in each of said transverse bulkheads (3) the relevant stiffening ribs (4) stop at a preset distance from said contact area (6) so that in each of said transverse bulkheads (3) a transversal strip(S) without stiffening ribs (4) straddling the relevant contact area (6) in correspondence with said deck (2) is identified.

11. The hull structure according to claim 10, wherein said transverse strip(S) of said transverse bulkheads (3) without stiffening ribs (4) has an increased thickness by 15-35% with respect to the remaining part of the bulkhead where said stiffening ribs are located.

12. The hull structure according to claim 1, wherein said suitably fiber reinforced plastic material base is a thermosetting composite material comprising fibers and/or reinforcing fillers.

13. The hull structure according to claim 1, wherein:

said transverse bulkheads (3) are made up of transverse structural bulkheads, both watertight and otherwise, of the hull;

said transverse bulkheads (3), said at least one deck (2) and said cradle-shaped bearing elements (5) are made of said suitably fiber reinforced plastic material-based composite material; and said at least one deck (2) comprises longitudinal and/or transverse stiffeners, which terminate at a predetermined distance of at least 10 cm from the transvers bulkheads (if longitudinal) or from the plating (if transverse) with corresponding flute-beak tapered ends.

14. A hull structure based on suitably reinforced plastic material, wherein said hull structure extends from bow to stern in a longitudinal direction (X-X) and includes a "single skin" monocoque plating and an internal stiffening structure (1), wherein said internal stiffening structure (1) comprises:

at least one deck (2);

at least two opposite transverse bulkheads (3) extended vertically and in a transverse direction (Y-Y) orthogonal to said longitudinal direction (X-X) and to said at least one deck (2); and one or more cradle-shaped load-bearing elements (5) to support machinery intended to be housed on said hull structure, said one or more cradle-shaped load-bearing elements (5) extending in said longitudinal direction (X-X) between opposite head ends (5*b*), wherein said one or more cradle-shaped load-bearing elements (5) are supported:

only at said opposite head ends (5*b*) of said cradle-shaped load-bearing elements (5) and only from respective first portions of said opposite transverse bulkheads (3), wherein said one or more cradle-shaped load-bearing elements (5) comprise a plurality of distinct and parallel elements in said transverse direction (Y-Y).

15. The hull structure according to claim 1, comprising more than two transverse bulkheads (3) offset from each other in said longitudinal direction (X-X), more decks (2) extended between said transverse bulkheads (3) and/or more cradle-shaped load-bearing elements (5) extended between said transverse bulkheads (3) to support said machinery.

16. A ship comprising a hull structure in accordance with claim 1, said ship comprising machinery supported by said cradle-shaped load-bearing elements (5), said on-board machinery being chosen from the group comprising: engines, generators and/or other devices or other equipment required on board the ship during navigation.

* * * * *